US007289751B2

(12) United States Patent
Ito et al.

(10) Patent No.: US 7,289,751 B2
(45) Date of Patent: Oct. 30, 2007

(54) HIGH RESOLUTION IMAGE FORMING APPARATUS

(75) Inventors: Katsuyuki Ito, Tokyo (JP); Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 99 days.

(21) Appl. No.: 11/126,366

(22) Filed: May 11, 2005

(65) Prior Publication Data

US 2005/0260012 A1 Nov. 24, 2005

(30) Foreign Application Priority Data

May 18, 2004 (JP) ..... 2004-147602

(51) Int. Cl.
*G03G 15/00* (2006.01)

(52) U.S. Cl. ..... 399/159; 399/279

(58) Field of Classification Search ..... 399/159, 399/222, 252, 53, 265, 279; 430/120, 902, 430/110.1, 110.3, 110.4
See application file for complete search history.

(56) References Cited

U.S. PATENT DOCUMENTS 5,043,769 A * 8/1991 Osawa et al. ..... 399/351
6,282,400 B1 * 8/2001 Aoki et al. ..... 399/350
6,346,356 B1 * 2/2002 Ohno et al. ..... 430/108.2
2001/0038763 A1 * 11/2001 Aoki et al. ..... 399/267
2002/0039496 A1 * 4/2002 Aoki et al. ..... 399/55
2003/0059693 A1 * 3/2003 Ikegami et al. ..... 430/59.2
2003/0206754 A1 * 11/2003 Morita et al. ..... 399/299
2003/0215726 A1 * 11/2003 Sugino et al. ..... 399/159 X
2004/0141772 A1 * 7/2004 Goto ..... 399/222
2004/0234294 A1 * 11/2004 Nagame et al. ..... 399/159
2005/0111880 A1 * 5/2005 Fujii et al. ..... 399/159
2005/0142472 A1 * 6/2005 Sekido et al. ..... 399/159 X

FOREIGN PATENT DOCUMENTS

JP 2000-108409 4/2000
JP 2002-287387 A * 10/2002
JP 2003-177563 A * 6/2003

* cited by examiner

*Primary Examiner*—Sophia S. Chen
(74) *Attorney, Agent, or Firm*—Rabin & Berdo, P.C.

(57) ABSTRACT

An image forming apparatus includes a photosensitive body (11) having a charge transport layer (11*d*) as a surface layer. The charge transport layer (11*d*) as the surface layer is charged and exposed so that a latent image is formed thereon. In order to form a basic dot whose diameter is from 10 μm to 25 μm, a thickness t (μm) of the charge transport layer (11*d*) and a diameter D (μm) of the basic dot satisfy the relationship of t≦D/2.

7 Claims, 4 Drawing Sheets

HIGH RESOLUTION IMAGE FORMING APPARATUS

BACKGROUND OF THE INVENTION

This invention relates to an image forming apparatus such as a printer, a copier or the like that uses electrophotographic technology.

Conventionally, there is proposed an image forming apparatus that forms a latent image by irradiating a surface layer of a photosensitive body whose thickness is less than or equals to 15 μm with the light beam whose diameter is less than or equals to 50 μm. The amount of the toner that forms a dot image is 1.2 times the amount of the toner that forms an area image, so as to enhance the image quality. Such a technology is disclosed in, for example, Japanese Laid-open Patent Publication No. 2000-108409 (particularly, in Page 3 and FIG. 1).

Recently, the image forming apparatus generally has the resolution of 600 DPI, and the development work to further enhance the resolution of the image forming apparatus has already started. Although an exposure (i.e., scanning) of high resolution image data has been accomplished, it is difficult to reproduce a single dot on a recording medium corresponding to such a resolution, and therefore it is difficult to obtain high quality print output corresponding to the high resolution image data. Particularly, the conventional image forming apparatus is not able to reproduce the minute dot whose diameter is approximately less than or equals to 25 μm, corresponding to the higher resolution of, for example, 1200 DPI and 2400 DPI.

SUMMARY OF THE INVENTION

An object of the present invention is to provide an image forming apparatus capable of printing an image with the resolution of approximately 2400 DPI, and stably keeping the printing performance during the lifetime of the image forming apparatus.

The invention provides an image forming apparatus including a photosensitive body having a charge transfer layer as a surface layer charged and exposed so that a latent image is formed thereon. In order to form a basic dot whose diameter is from 10 μm to 25 μm, a thickness t (μm) of the charge transport layer and a diameter D (μm) of the basic dot satisfy the relationship: $t \leqq D/2$.

The invention also provides another image forming apparatus including a photosensitive body having a charge transport layer as a surface layer charged and exposed so that a latent image is formed thereon, and a developer bearing body that contacts said photosensitive body and develops the latent image. In order to form a basic dot whose diameter is from 10 μm to 25 μm, the developer bearing body is urged against the photosensitive body with an urging force from 10 g/cm to 50 g/cm per unit length of a contact portion of the photosensitive body and the developer bearing body.

The invention also provides further image forming apparatus including a photosensitive body having a charge generation/transport layer as a surface layer charged and exposed so that a latent image is formed thereon, and a developer bearing body that contacts said photosensitive body and develops the latent image. In order to form a basic dot whose diameter is from 10 μm to 25 μm, the developer bearing body is urged against the photosensitive body with an urging force from 10 g/cm to 50 g/cm per unit length of a contact portion of the photosensitive body and the developer bearing body.

With such an arrangement, it becomes possible to reproduce the dot corresponding to the resolution of 1200 DPI and 2400 DPI, and to stably keep the printing performance during the lifetime of the image forming apparatus.

DESCRIPTION OF THE PREFERRED EMBODIMENT

Embodiments of the present invention will be described with reference to the attached drawings.

Embodiment 1

Figure 1:
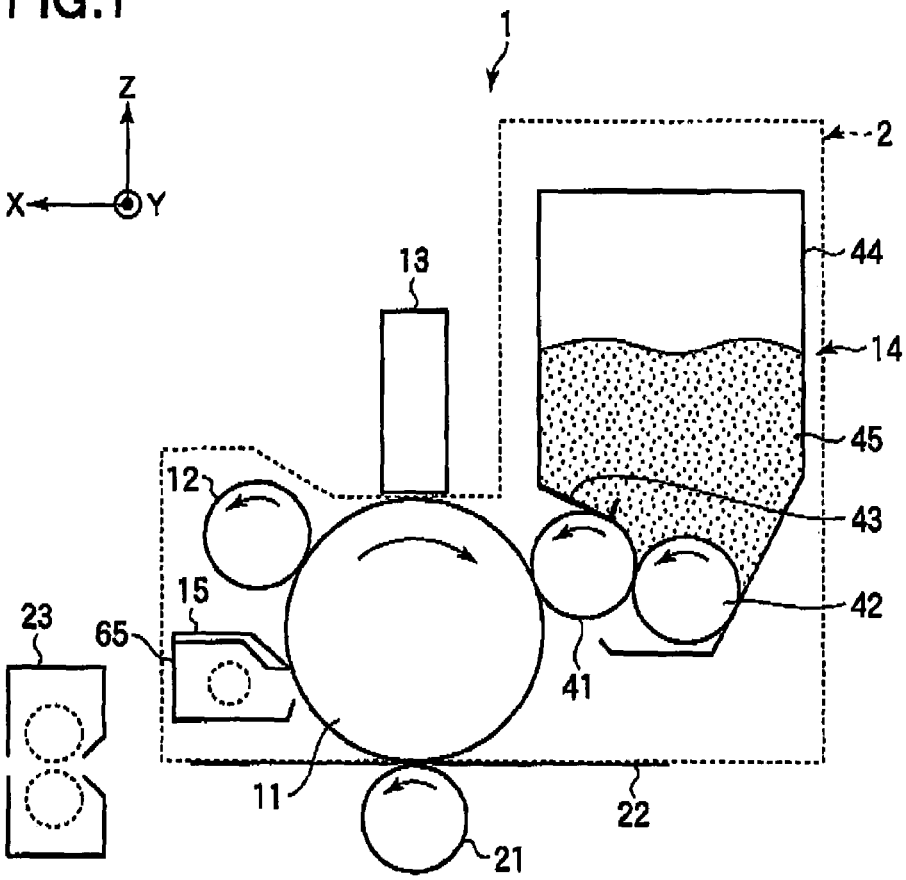
FIG. 1 is a side view showing a configuration of a main part of an image forming apparatus according to Embodiment 1 of the present invention.

FIG. 1 is a side view showing a configuration of a main part of an image forming apparatus 1 according to Embodiment 1 of the present invention.

As shown in FIG. 1, the image forming apparatus includes a laminate-type photosensitive drum 11. The photosensitive drum 11 has laminated charge generation layer and charge transport layer (described later) at the surface thereof, and the charge transport layer constitutes a surface layer of the photosensitive drum 11. The charging roller 12 applies a negative DC voltage to the photosensitive drum 11 and applies an electric charge to the surface layer of the photosensitive drum 11, so that the surface layer is charged to an electric potential from −300V to −600V. The charging roller 12 rotates together with the photosensitive drum 11 in the direction shown by an arrow in FIG. 1, so as to restrict the decrease of the thickness of the surface layer of the photosensitive drum 11. The exposing device 13 includes an optical writing device having laser or LED (Light Emitting Diode) as light sources. The exposing device 13 selectively exposes the surface layer of the photosensitive drum 11 to form a latent image on the surface layer of the photosensitive drum 11.

A developing device 14 includes a toner container 44, a developing roller 41, a toner supply roller 42 and a developing blade 43. The toner container 44 stores a toner 45 therein. The toner supply roller 42 supplies the toner 45 to the developing roller 41. The developing blade 43 forms a thin layer of the toner 45 on the developing roller 41. The developing device 14 causes the developing roller 41 (that bears the toner 45) to be urged against the photosensitive drum 11 so that the latent image on the surface of the photosensitive drum 11 is developed (i.e., visualized) with the toner 45 as described later. The developing roller 41 and the toner supply roller 42 has rotation axes parallel with each other, and are urged against each other with uniform pressure. The developing roller 41 and the toner supply roller 42 rotate in the same directions as shown by arrows in FIG. 1. The developing blade 43 and the developing roller 41 are disposed in parallel to each other so that a bent portion of the developing blade 43 is urged against the developing roller 41 with a uniform pressure.

The toner image formed on the photosensitive drum 11 is transferred to the recording medium 22 by a transfer roller 21 to which a predetermined high voltage is applied. The transfer roller 21 is disposed in opposition to the photosensitive drum 11 so that the recording medium 22 is nipped between the transfer roller 21 and the photosensitive drum 11. The transfer roller 21 and the photosensitive drum 11 rotate together with each other so as to feed the nipped recording medium 22. The toner layer that has been transferred to the recording medium 22 is fixed to the recording medium 22 when the recording medium 22 passes a fixing device 23. After the transferring of the toner image, the toner 45 that remains on the photosensitive drum 11 is scraped by a cleaning blade 15. The cleaning blade 15 is disposed in parallel to the photosensitive drum 11 so that the cleaning blade 15 is urged against the surface of the photosensitive drum 11 with a uniform force. The residual toner scraped by the cleaning blade 15 is recovered by a toner recovering mechanism 65, and is carried by a not-shown toner carrying mechanism to a waste toner accommodating portion.

The photosensitive drum 11, the charging roller 12, the developing device 14, the cleaning blade 15 and the toner recovery mechanism 65 (indicated by a dashed line in FIG. 1) are integrally constructed as a drum cartridge 2. It is possible that the drum cartridge 2 is detachably attached to a main body of the image forming apparatus 1.

In FIG. 1, X-axis is defined in the feeding direction of the recording medium 22, and Y-axis is defined in the direction of the rotation axis of the photosensitive drum 11. Z-axis is defined to be perpendicular to both of X-axis and Y-axis. In other figures, the X-axis, Y-axis and Z-axis indicate the same directions as those shown in FIG. 1.

Figure 2:
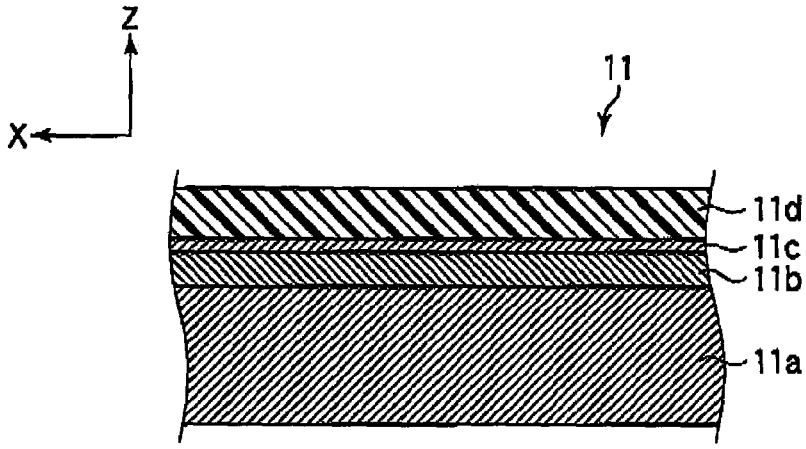
FIG. 2 is an enlarged sectional view cut by XZ-plane, showing a part in the vicinity of a surface of a photosensitive drum.

FIG. 2 is an enlarged sectional view of a part in the vicinity of the surface of the photosensitive drum 11, cut by XZ plane.

The photosensitive drum 11 includes a conductive base 11*a* made of metal in the shape of cylinder, an undercoat layer 11*b* formed on the conductive base 11*a*, a charge generation layer (CGL) 11*c* formed on the undercoat layer 11*b*, a charge transport layer (GTL) 11*d* formed on the charge generation layer 11*c*. The undercoat layer 11*b* is made of an inorganic material with a predetermined electric resistance, and has a function to prevent the entry of the electric charge moved from the conductive base 11*a* and to cancel the imperfections of the conductive base 11*a*. The charge generation layer 11*c* is made of an organic optical semiconductive material that absorbs the light energy to generate positive and negative electric charge. The thickness of the charge generation layer 11*c* is less than or equals to 1 μm. The charge transport layer 11*d* is made of an organic optical semiconductive material and a resin material, and has a function to transport the electric charge generated (in this case, the positive electric charge) by the charge generation layer 11*c* to the surface of the photosensitive drum 11, so as to neutralize the charged voltage (in this case, the negatively charged voltage) of the surface of the photosensitive drum 11.

Figure 3:
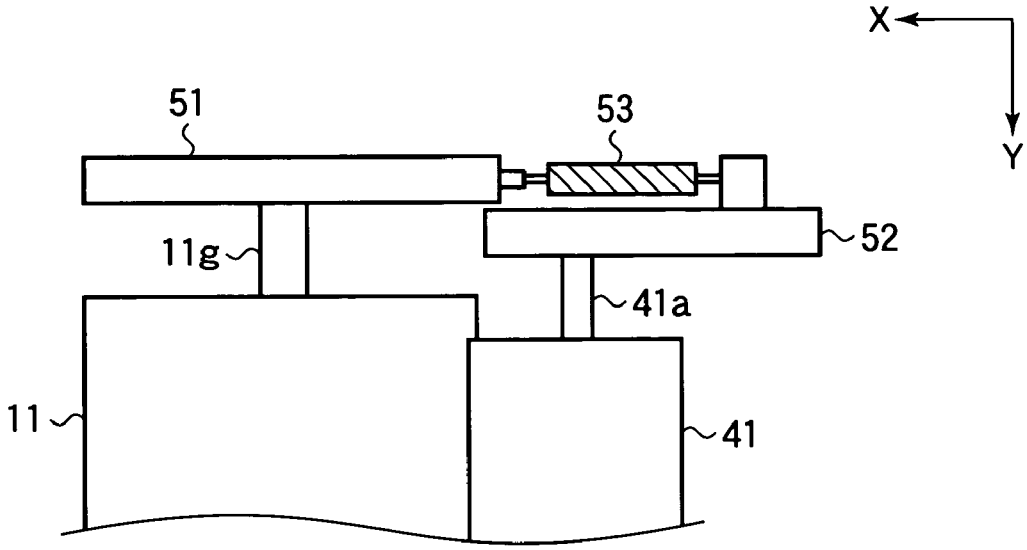
FIG. 3 is a side view showing an urging mechanism for urging a developing roller against the photosensitive drum with a uniform pressure, seen form the above along Z-axis at ends of the photosensitive drum and the developing roller.

FIG. 3 is a top view of an urging mechanism for urging the developing roller 41 against the photosensitive drum 11 with a constant pressure. In FIG. 3, the urging mechanism at an end portion of the photosensitive drum 11 and the developing roller 41 is illustrated in the direction seen from above along Z-axis.

As shown in FIG. 3, the photosensitive drum 11 has a rotation axis 11*g* rotatably supported by bearings provided on a stationary frame 51 disposed on a main body of the drum cartridge 2 (FIG. 1). The developing roller 41 has a rotation axis 41*a* rotatably supported by bearings provided on a movable frame 52. The same urging mechanism is provided on the other end portion of the photosensitive drum 11 and the developing roller 41 in, for example, a symmetrical manner.

The movable frame 52 is guided by the main body of the drum cartridge 2 (FIG. 1), and is movable so that the rotation axis 41*a* of the developing roller 41 is kept parallel to the rotation axis 11*g* of the photosensitive drum 11 (i.e., the rotation axes 41*a* and 11*g* are aligned on the same plane). A coil spring 53 extends between the stationary frame 51 and the movable frame 52, and pulls the frames 51 and 52 toward each other. The pressure with which the photosensitive drum 11 and the developing roller 41 (bearing the toner 45) are urged against each other can be adjusted by varying the strength of the coil spring 53.

The reproducing test of a single basic dot using the image forming apparatus 1 of FIG. 1 will be described. Hereinafter, "the diameter of the basic dot" is used to mean the diameter of the dot as the minimum unit of the printed image.

In this test, an LED head including an array of LED light sources is used as the exposing device 13. By varying the areas of the LED light sources, the diameter of the beam spot for exposure is adjusted, with the result that the diameter of the basic dot of the latent image on the surface of the photosensitive drum 11 is adjusted. A lens array is used as an optical system of the LED head. The diameter of the beam spot for exposure is set according to "1010" pattern. The MFG (Modulation Transfer Function) is 70%. The MFG is calculated based on the strength amplitude reproduced by the optical system or the like as follows:

$$(S_{Max}-S_{min})/(S_{Max}+S_{Min})\times 100$$

where $S_{Max}$ and $S_{Min}$ are respectively the maximum value and the minimum value of the strength amplitude. Further, the above described "1010" pattern is that dots (i.e., ON dots) and blank dots (i.e., OFF dots) are alternatively arranged in lateral direction and in vertical direction. With the "1010" pattern, the reproducibility can be determined by comparing (and evaluating) the adjacent dots with each other.

The toner used in the test is made by polymerization. The degree of circularity of the toner is 0.95, and the particle diameter (mean volume diameter) of the toner is 5.0 μm. In this regard, the toner can be made of pulverized toner processed into spherical shape. Further, the degree of circularity of the toner can be ranged from 0.90 to 0.99. The particle diameter of the toner can be ranged from 3.0 μm to 9.0 μm. The developing roller 41 used in the test has the surface roughness from 1 to 10 μm. The surface of the developing roller 41 is made of urethane rubber, urethane resin, silicone rubber, silicone resin, Epichlorohydrin rubber or the like.

Other test condition will be described below.

The surface roughness of the photosensitive drum 11 is from 0.1 μm to 2.0 μm, although the photosensitive drum 11 of Embodiment 1 is not limited to have the surface roughness of this range.

The undercoat layer 11*b* is made of alumite, titanium oxide or the like. The resistance of the undercoat layer 11*b* is from 1 KΩ/cm$^2$ to 1 MΩ/cm$^2$. The thickness of the undercoat layer 11*b* is from 1.0 μm to 60 μm.

The charge generation layer 11*c* is made of phthalocyanine pigment whose core is made of aluminum or the like.

The charge transport layer 11*d* is made of a resin of polycarbonate or the like in which a chemical compound (for example, hydrazone) having a charge transport property is included.

According to the above described condition, the thickness of the charge transport layer 11*d* of the photosensitive drum 11 (FIG. 2) is varied as a parameter, and the basic dots of several diameters are printed on the recording medium 22. The reproducibility of the basic dot is evaluated by observing the toner image of the basic dot formed on the recording medium 22. The result of the evaluation is shown in Table 1.

TABLE 1

| Thickness Of Charge Transport Layer 11d | Diameter of Basic Dot (μm) | | | |
|---|---|---|---|---|
| | 10 | 15 | 20 | 25 |
| 1 | o | o | o | o |
| 2 | o | o | o | o |
| 3 | o | o | o | o |
| 4 | o | o | o | o |
| 5 | o | o | o | o |
| 6 | o | o | o | o |
| 7 | x | o | o | o |
| 8 | x | o | o | o |
| 9 | x | x | o | o |
| 10 | x | x | o | o |
| 11 | x | x | x | o |
| 12 | x | x | x | o |
| 13 | x | x | x | o |
| 14 | x | x | x | x |
| 15 | x | x | x | x |

In the above Table 1, the mark "o" indicates that the toner is collected to substantially form a circle, and the reproducibility of the basic dot is recognized. The mark "x" indicates that the toner is dispersed, and the reproducibility of the basic dot is not recognized. In the test using the above described "1010" pattern, the evaluation is "o" when the dots (ON dots) are not overlapped with each other, and the evaluation is "x" when the dots are partially overlapped with each other.

Based on the evaluation shown in Table 1, the reproducibility of the basic dot is determined by the thickness of the charge transport layer 11*d* of the photosensitive drum 11 within the range in which the test is carried out. When the thickness of the charge transport layer 11*d* of the photosensitive drum 11 is less than or equals to 10 μm, it becomes possible to reproduce the basic dot with the diameter of 22 μm. When the thickness of the charge transport layer 11*d* of the photosensitive drum 11 is less than or equals to 5 μm, it becomes possible to reproduce the basic dot with the diameter of 11 μm. Based on Table 1, when the evaluation "o" is obtained, the diameter D of the basic dot and the thickness t of the charge transport layer 11*d* satisfy the relationship: $D/2 \geqq t$.

It is understood that the reason why the reproducibility of the basic dot is determined by the thickness of the charge transport layer 11*d* of the photosensitive drum 11 is as follows. The electric charge generated by the charge generation layer 11*c* (that absorbs the light energy of exposure) is diffused in the charge transport layer 11*d* before the electric charge approaches the surface of the photosensitive drum 11. Thus, as the charge transport layer 11*d* becomes thicker, the reproduced basic dot is broadened, so that the basic dot is not sharply reproduced.

Next, the test to determine the decreasing amount of the thickness of the surface layer of the photosensitive drum 11 will be described.

Figure 4:
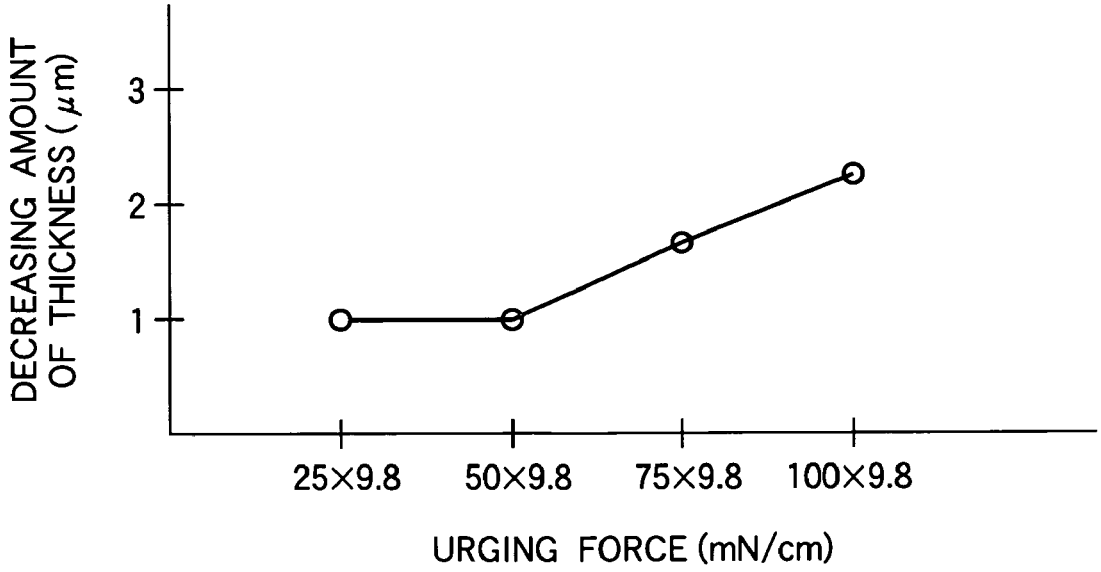
FIG. 4 is a graph showing the experimental result to determine the relationship between an urging force with which the developing roller is urged against the photosensitive drum and a decreasing amount of the thickness of a surface layer of the photosensitive drum of the image forming apparatus according to Embodiment 1.

FIG. 4 is a graph of the experimentally determined relationship between the urging force with which the developing roller 41 is urged against the photosensitive drum 11 and the decreasing amount of the thickness of the surface layer of the photosensitive drum 11. In FIG. 4, the lateral axis indicates the urging force generated by the coil spring 53 (FIG. 3) divided by the length with which the developing roller 41 contacts the photosensitive drum 11. In other words, the lateral axis indicates the urging force per unit length. The vertical axis indicates the decreasing amount of the thickness of the surface layer of the photosensitive drum 11, when 10000 pages have been printed.

The urging force is varied by adjusting the strengths of the pair of the coil springs 53 of the urging mechanisms (one of which is shown in FIG. 3) provided on both end portions of the photosensitive drum 11 and the developing roller 41. The circumferential speed of the developing roller 41 is set to be 1.3 times the circumferential speed of the photosensitive drum 11.

As shown in FIG. 4, the decreasing amount of the thickness of the surface layer of the photosensitive drum 11 is in proportion to the urging force when the urging force is larger than a predetermined force. When the urging force is set to approximately 50 g/cm (50×9.8 mN/cm), the decreasing amount of thickness of the surface layer of the photosensitive drum 11 is approximately 1 μm when 10000 pages have been printed. However, when the urging force is gradually reduced, the decreasing amount of the thickness of the surface layer of the photosensitive drum 11 does not change. It is understood that, as the urging force becomes smaller, the primary factor of the decreasing the thickness of the surface layer shifts from the developing roller 41 to other components such as the charging roller 12, the transfer roller 21 or the cleaning blade 15.

The matters to be considered for determining the urging force of the developing roller 41 are as follows:

(1) In consideration of the variations of the surface condition and the diameter in the axial direction of the photosensitive drum 11 and the developing roller 41, it is necessary to apply a sufficient urging force throughout the axial length of the developing roller 41, and the lower limit of the urging force is preferably 10 g/cm.

(2) The lifetime of the photosensitive drum 11 is preferably the same as a replacement period (i.e., lifetime) of the drum cartridge 2 shown in FIG. 1. For example, the lifetime of the photosensitive drum 11 is preferably approximately 20000 pages of printing.

(3) The photosensitive drum 11 needs to have a uniform charging property, and therefore the charge transport layer 11*d* with the thickness of at least 2 μm needs to remain during the lifetime of the photosensitive drum 11. This is because if the thickness of the surface layer is further reduced, the electric leakage between the charging roller 12 and the conductive base 11*a* of the photosensitive drum 11 may occur, so that the charge transport layer 11*d* can not hold the electric charge and may cause the failure in development.

(4) In order to reproduce the basic dot with the diameter of approximately 11 μm (corresponding to the resolution of 2400 DPI), the thickness of the charge transport layer 11*d* is set to be less than or equal to 5 μm according to the above described test result.

In consideration of the above described matters, if the initial thickness of the charge transport layer 11*d* is 5 μm (when the photosensitive drum 11 is started to be used), the allowable decreasing amount of the thickness of the charge transport layer 11*d* is 3 μm at the maximum when 20000 pages have been printed. If the decreasing amount of the thickness when 20000 pages have been printed is assumed to be double as the decreasing amount of the thickness shown in FIG. 4 (when 10000 pages have been printed), the allowable urging force is 60 g/cm (60×9.8 mN/cm) corresponding to the decreasing amount of the thickness of 1.5 μm. Therefore, the urging force of the developing roller 41 is set by the coil spring 53 in the range from 10 g/cm (10×9.8 mN/cm) to 50 g/cm (50×9.8 mN/cm) in consideration of the variation. When the urging force of the developing roller 41 is set from 10 g/cm to 50 g/cm, the initial thickness of the charge transport layer 10*d* must be greater than or equals to 4 μm, because the thickness of the charge transport layer 11*d* needed to remain during the lifetime of the photosensitive drum 11 is 2 μm, and the decreasing amount of the thickness of the charge transport layer 11*d* is 2 μm.

As described above, according to Embodiment 1 of the present invention, by setting the thickness of the charge transport layer 11*d* of the photosensitive drum 11 to be less than or equals to the predetermined thickness, it becomes possible to reproduce the basic dot corresponding to 1200 DPI and further to reproduce the basic dot corresponding to 2400 DPI. Although the initial thickness of the charge transport layer 11*d* needs to be thin (for example, from 5 to 11 μm), the decreasing amount of the charge transport layer 11*d* can be restricted by setting the urging force of the developing roller 41 urged against the photosensitive drum 11 within a predetermined range. Therefore, the lifetime of the photosensitive drum 11 can be longer than or equals to the lifetime of the drum cartridge 2 (for example, approximately 20000 prints).

Embodiment 2

Figure 5:
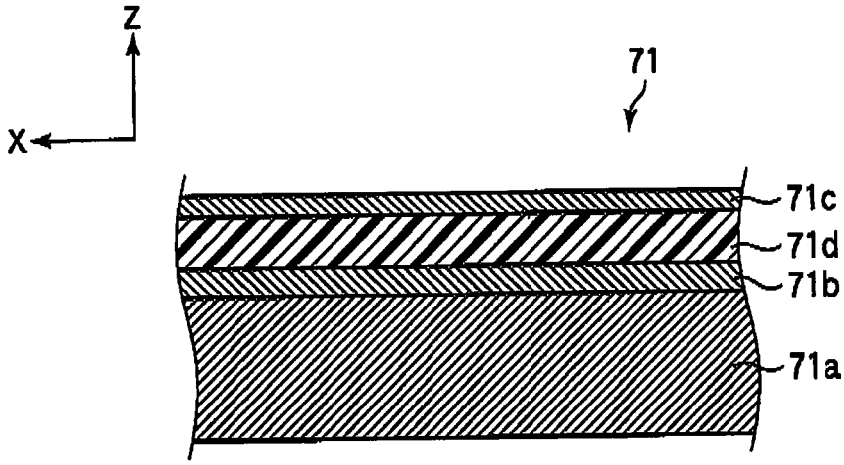
FIG. 5 is an enlarged sectional view cut by XZ-plane, showing a part in the vicinity of a surface of a photosensitive drum used in an image forming apparatus according to Embodiment 2 of the present invention.

FIG. 5 is an enlarged sectional view of a part in the vicinity of the surface of a photosensitive drum 71 used in an image forming apparatus according to Embodiment 2, cut by XZ plane.

The image forming apparatus according to Embodiment 2 is different from that of Embodiment 1 (FIG. 1) in the structure of the laminated portion of the photosensitive drum 71 and the polarities of the voltages applied to the photosensitive drum 71 or the like. The components of the image forming apparatus of Embodiment 2 that are the same as (or correspond to) those of Embodiment 1 are assigned the same reference numerals, and the duplicate explanation and drawing are omitted. The description is emphasized on the difference of the image forming apparatus of Embodiment 2 from that of Embodiment 1.

As shown in FIG. 5, the photosensitive drum 71 includes a conductive base 71*a* made of metal in the shape of cylinder, an undercoat layer 71*b* formed on the conductive base 71*a*, a charge transport layer 71*d* formed on the undercoat layer 71*b*, and a charge generation layer 71*c* (i.e., a surface layer) formed on the charge transport layer 71*d*. The undercoat layer 71*b* is made of an inorganic material with a predetermined resistance, and has a function to prevent the entry of the electric charge moved from the conductive base 71*a* and to cancel the imperfections of the conductive base 71*a*. The charge generation layer 71*c* is made of an organic optical semiconductive material that absorbs the light energy to generate positive and negative electric charges. The negative electric charge neutralizes the positively charged voltage of the surface of the photosensitive drum 71, and the positive electric charge is transmitted to the charge transport layer 71*d*. The thickness of the charge generation layer 71*c* is approximately 3 μm. The charge transport layer 71*d* is made of an organic optical semiconductive material and a resin material, and has a function to transport the electric charge (the positive electric charge) generated by the charge generation layer 71*c* to the undercoat layer 71*b*.

In Embodiment 2, the charging roller 12 (FIG. 1) applies positive DC voltage to the photosensitive drum 71 so as to charge the surface layer of the photosensitive drum 71 from +300 V to +600 V. The charging roller 12 rotates together with the photosensitive drum 71 so as to restrict the decrease of the thickness of the surface layer of the photosensitive drum 71.

The reproducing test of a single basic dot using the image forming apparatus of Embodiment 2 will be described. The method and condition of the test is the same as those described in Embodiment 1, and the duplicate explanation is omitted.

The thicknesses of the charge transport layer 71*d* and the charge generation layer 71*c* of the photosensitive drum 71 are varied as parameters, and the basic dots of several diameters are printed on the recording medium 22. The reproducibility of the basic dot is evaluated by observing the toner image of the basic dot formed on the recording medium 22. As a result of the test, it is recognized that the basic dot with the diameter of 22 μm and the basic dot with the diameter of 11 μm can be reproduced, and the reproducibility does not depend on the thicknesses of the charge transport layer 71*d* and the charge generation layer 71*c*. It is understood that the reason is as follows: In the photosensitive drum 71, the charge generation layer 71*c* absorbs the light energy of exposure, and generates positive and negative electric charge in the vicinity of the surface of the charge generation layer 71*c*. The negative charge generated in the vicinity of the surface of the charge generation layer 71*c* neutralizes the positively charged voltage on the surface of the charge generation layer 71*c*. Accordingly, the diffusion of the electric charge (negative electric charge) is restricted, irrespective of the thicknesses of the charge transport layer 71*d* and the charge generation layer 71*c*, and therefore the reproduced basic dot tends not to be broadened.

Next, the test to determine the decreasing amount of the thickness of the surface layer of the photosensitive drum 71 will be described. The method and condition of the test is the same as those described in Embodiment 1, and the duplicate explanation is omitted.

Figure 6:
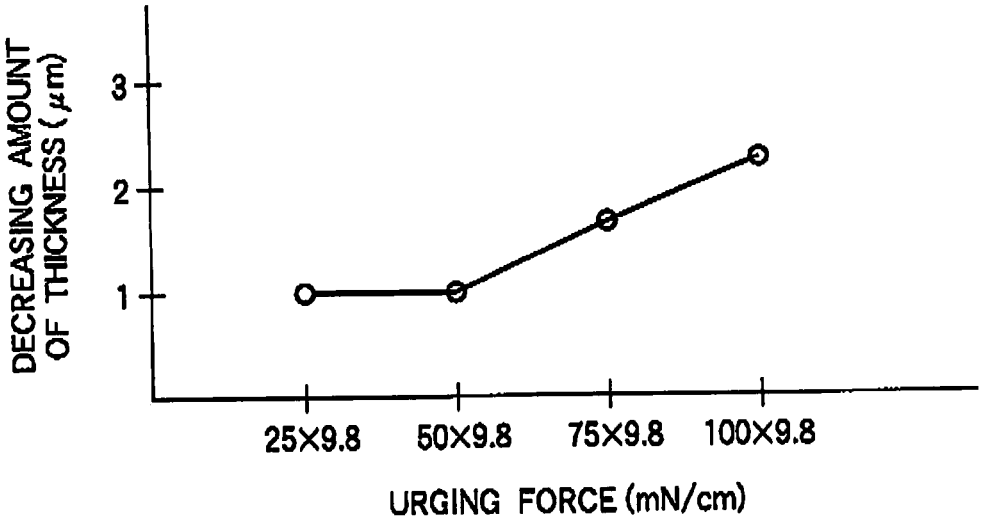
FIG. 6 is a graph showing the experimental result to determine the relationship between an urging force with which the developing roller is urged against the photosensitive drum and a decreasing amount of the thickness of a surface layer of the photosensitive drum of the image forming apparatus according to Embodiment 2.

FIG. 6 is a graph showing the experimental result. As shown in FIG. 6, the decreasing amount of the surface layer of the photosensitive drum 71 is in proportion to the urging force when the urging force is larger than the predetermined force. When the urging force is set to approximately 50 g/cm, the decreasing amount of the thickness of the surface layer of the photosensitive drum 71 is approximately 1 μm when 10000 pages have been printed. However, when the urging force is gradually reduced, the decreasing amount of the thickness of the surface layer of the photosensitive drum 71 does not change. It is understood that, as the urging force becomes smaller, the primary factor of the decreasing the thickness of the surface layer shifts from the developing roller 41 to other components such as the charging roller 12, the transfer roller 21 or the cleaning blade 15.

In the case where the urging force is set from 10 g/cm to 50 g/cm, the decreasing amount when 10000 pages have been printed is approximately 1 μm. Thus, the decreasing amount when 2000 pages have been printed is assumed to be 2 μm. Therefore, if the thickness of the charge generation layer 71*c* is set to be greater than or equal to 3 μm, the charge generation layer 71*c* with the thickness of approximately at least 1 μm can remain while 2000 pages have been printed. Therefore, the lifetime of the photosensitive drum 71 can be longer than or equal to the replacement period of the drum cartridge 2 (for example, approximately 20000 pages of printing).

As described above, according to Embodiment 2 of the present invention, by using the photosensitive drum 71 having the charge generation layer 71*c* as the surface layer, it becomes possible to reproduce the basic dot corresponding to 1200 DPI, and to further reproduce the basic dot corresponding to 2400 DPI. Further, the decreasing amount of the thickness of the charge transport layer 71*d* can be restricted by setting the urging force of the developing roller 41 urged against the photosensitive drum 71 in the range from 10 g/cm to 50 g/cm, with the result that the lifetime of the photosensitive drum 71 can be longer than or equals to the lifetime of the drum cartridge 2 (for example, approximately 20000 prints).

Embodiment 3

Figure 7:
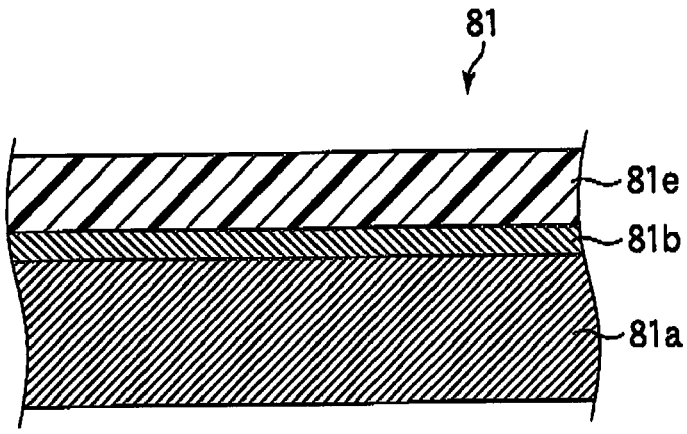
FIG. 7 is an enlarged sectional view cut by XZ-plane, showing a part in the vicinity of a surface of a photosensitive drum used in an image forming apparatus according to Embodiment 3 of the present invention.

FIG. 7 is an enlarged sectional view of a part in the vicinity of the surface of the photosensitive drum 81 used in an image forming apparatus according to Embodiment 3, cut by XZ plane.

The image forming apparatus according to Embodiment 3 is different from that of Embodiment 1 (FIG. 1) in the structure of the laminated portion of the photosensitive drum 81 and the polarities of the voltages applied to the photosensitive drum 81 or the like. The components of the image forming apparatus of Embodiment 3 that are the same as (or correspond to) those of Embodiment 1 are assigned the same reference numerals, and the duplicate explanation and drawing are omitted. The description is emphasized on the difference of the image forming apparatus of Embodiment 3 from that of Embodiment 1.

As shown in FIG. 7, the photosensitive drum 81 includes a conductive base 81*a* made of metal in the shape of cylinder, an undercoat layer 81*b* formed on the conductive base 81*a*, and a charge generation/transport layer 81*e* formed on the undercoat layer 81*b*. The undercoat layer 81*b* is made of an inorganic material with a predetermined resistance, and has a function to prevent the entry of the electric charge moved from the conductive base 81*a* and to cancel the imperfections of the conductive base 81*a*. The charge generation/transport layer 81*e* is made of an organic optical semiconductive material and a resin material. The charge generation/transport layer 81*e* absorbs the light energy to generate positive and negative electric charge. The negative electric charge neutralizes the positively charged voltage of the surface of the photosensitive drum 11, and positive electric charge is transmitted to the undercoat layer 81*a*. The thickness of the charge generation/transport layer 81*e* is approximately 20 μm.

In Embodiment 3, the charging roller 12 (FIG. 1) applies positive DC voltage to the photosensitive drum 81 so as to charge the surface layer of the photosensitive drum 81 from +300 V to +600 V. The charging roller 12 rotates together with the photosensitive drum 81 so as to restrict the decrease of the thickness of the surface layer of the photosensitive drum 81.

The reproducing test of a single basic dot using the image forming apparatus of Embodiment 3 will be described. The method and condition of the test are the same as those described in Embodiment 1, and the duplicate explanation is omitted.

The thickness of the charge generation/transport layer 81*e* of the photosensitive drum 81 is varied as a parameter, and the basic dots of several diameters are printed on the recording medium 22. The reproducibility of the basic dot is evaluated by observing the toner image of the basic dot formed on the recording medium 22. As a result of the test, it is recognized that the basic dot with the diameter of 22 μm and the basic dot with the diameter of 11 μm can be reproduced, and the reproducibility does not depend on the thicknesses of the charge generation/transport layer 81*e*. It is understood that the reason is as follows. In the photosensitive drum 81, the charge generation/transport layer 81*e* absorbs the light energy of exposure, and generates positive and negative electric charge in the vicinity of the surface of the charge generation/transport layer 81*e*. The negative charge generated in the vicinity of the surface of the charge generation/transport layer 81*e* neutralizes the positively charged voltage of the surface of the charge generation/transport layer 81*e*. Accordingly, the diffusion of the negative electric charge is restricted, irrespective of the thickness of the charge generation/transport layer 81*e*, and therefore the reproduced basic dot tends not to be broadened.

Next, the test to determine the decreasing amount of the thickness of the surface layer of the photosensitive drum 81 will be described. The method and condition of the test are the same as those described in Embodiment 1, and the duplicate explanation is omitted.

Figure 8:
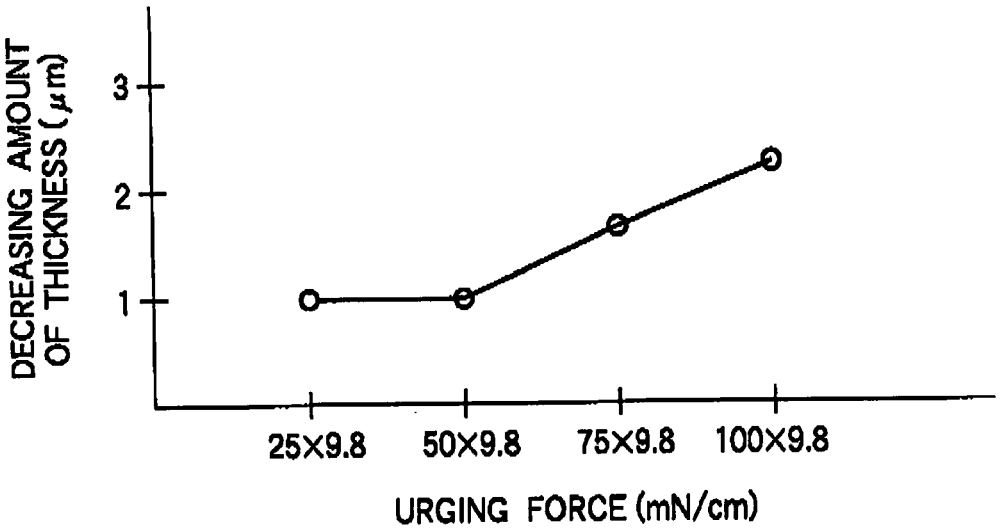
FIG. 8 is a graph showing the experimental result to determine the relationship between an urging force with which the developing roller is urged against the photosensitive drum and a decreasing amount of the thickness of a surface layer of the photosensitive drum of the image forming apparatus according to Embodiment 3.

FIG. 8 is a graph showing the experimental result. As shown in FIG. 8, the decreasing amount of the thickness of the surface layer of the photosensitive drum 81 is in proportion to the urging force when the urging force is larger than the predetermined force. When the urging force is set to approximately 50 g/cm (50×9.8 mN/cm), the decreasing amount of the thickness of the surface layer of the photosensitive drum 81 is approximately 1 μm when 10000 pages have been printed. However, when the urging force is gradually reduced, the decreasing amount of the thickness of the surface layer of the photosensitive drum 81 does not change. It is understood that, as the urging force becomes smaller, the primary factor of the decreasing the thickness of the surface layer shifts from the developing roller 41 to other components such as the charging roller 12, the transfer roller 21 or the cleaning blade 15.

In Embodiment 3, the thickness of the charge generation/transport layer 81*e* is set to 20 μm. However, Embodiment 3 is not limited to the generation/transport layer 81*e* with the thickness of 20 μm. By setting the thickness of the generation/transport layer 81*e* to be greater than or equal to the thickness needed for correct operation to which the decreasing amount based on FIG. 8 is added, it becomes possible to obtain the lifetime required for he photosensitive drum 81. In a particular example, the thickness of the generation/transport layer 81*e* can be approximately from 20 μm to 50 μm.

As described above, according to Embodiment 3 of the present invention, by using the photosensitive drum 81 having the charge generation/transport layer 81*e* as the surface layer, it becomes possible to reproduce the basic dot corresponding to 1200 DPI, and further to reproduce the basic dot corresponding to 2400 DPI. Further, the decreasing amount of the charge generation/transport layer 81*e* can be restricted by setting the urging force of the developing roller 41 urged against the photosensitive drum 81 in the range from 10 g/cm to 50 g/cm, with the result that the lifetime of the photosensitive drum 81 can be longer than or equals to the lifetime of the drum cartridge 2 (for example, approximately 20000 prints).

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a photosensitive body having a charge transport layer as a surface layer to be charged and exposed so that a latent image is formed thereon, and a developer bearing body that contacts said photosensitive body and develops said latent image formed on said photosensitive body, wherein, said charge transport layer has a thickness from 4 μm to 8 μm in order to form a basic dot whose diameter is from 10 μm to 25 μm, and wherein said developer bearing body is urged against said photosensitive body with an urging force from 10 g/cm to 50 g/cm per unit length of a contact portion of said photo sensitive body and said developer bearing body.

2. The image forming apparatus according to claim 1, wherein a circumferential speed of said developer bearing body is substantially 1.3 times a circumferential speed of said photosensitive body.

3. The image forming apparatus according to claim 1, wherein said photosensitive body further comprises a conductive base, an undercoat layer formed on said conductive base, and a charge generation layer formed on said undercoat layer, wherein said charge transport layer is formed on said charge generation layer.

4. The image forming apparatus according to claim 1, wherein said developer bearing body has a shaft with a rotation axis, and said shaft is slidable in a direction perpendicular to said rotation axis.

5. The image forming apparatus according to claim 1, further comprising an exposing unit that exposes said charge transport layer of said photosensitive body, said exposing unit including an LED head having an array of LED light sources.

6. The image forming apparatus according to claim 1, wherein a developer used for developing said latent image has degree of circularity from 0.90 to 0.99, and mean volume diameter of said developer is from 3.0 to 9.0 μm.

7. The image forming apparatus according to claim 1, wherein a thickness t (μm) of said charge transport layer and a diameter D (μm) of said basic dot satisfy the relationship $t \leqq D/2$.

* * * * *